United States Patent [19]

Seki

[11] Patent Number: 4,735,372

[45] Date of Patent: Apr. 5, 1988

[54] ROLLED WEB FEED APPARATUS

[75] Inventor: Yukuharu Seki, Hiroshima, Japan

[73] Assignee: Mitsubiski Jukogyo Kabushiki Kaisha, Tokyo, Japan

[21] Appl. No.: 16,132

[22] Filed: Feb. 18, 1987

[51] Int. Cl.[4] ..... B65H 19/12

[52] U.S. Cl. ..... 242/58.1

[58] Field of Search ..... 242/58–58.6, 242/79

[56] References Cited

U.S. PATENT DOCUMENTS

| | | | |
|---|---|---|---|
| 1,464,463 | 8/1923 | Wood | 242/58.1 |
| 4,170,506 | 10/1979 | Marschke | 242/58.1 X |
| 4,460,135 | 7/1984 | Hirakawa | 242/68.4 |
| 4,586,673 | 5/1986 | Tokuno et al. | 242/58.6 |

FOREIGN PATENT DOCUMENTS

| | | | |
|---|---|---|---|
| 309883 | 4/1929 | United Kingdom | 242/58.4 |

*Primary Examiner*—John M. Jillions

*Attorney, Agent, or Firm*—Bernard, Rothwell & Brown

[57] ABSTRACT

An improvement in a roll paper feed apparatus, having a pair of roll paper carrying arms, each of which is loadable with a roll of base paper, and a paper-splicing device, wherein a roll of paper can be fed in continuation from a paper processing stage to another by switching a supply of web from a plurality of rolls of paper placed in position ready for a splicing operation, and which comprises a roll paper feeding section or station in an opposed relationship with respect to the paper-splicing device, a pair of roll carrying means disposed opposedly on the both sides of the roll paper feeding section or station, each being adapted to be loaded rotatably with each of the roll of base paper at the top end thereof, respectively, and a pair of roll carrying arm means disposed in position between the roll paper feeding section or station and the roll paper carrying means and adapted to be rotated in swinging motion with respect to the roll paper feeding section or station.

4 Claims, 2 Drawing Sheets

ROLLED WEB FEED APPARATUS

FIELD OF THE INVENTION

The present invention relates to a rolled web feeding machine, and more particularly to a rolled web of paper feed apparatus such as a mill roll stand for use in a corrugated medium forming machine.

DESCRIPTION OF THE PRIOR ART

Before going any further, it will be helpful to the reader to give a general review on the conventional art of feeding rolled webs of paper with reference to FIG. 3.

Referring to FIG. 3, it is seen that there are provided rolls *3a* and *3b* of a web of base or blank paper held rotatably by a pair of roll carrying arms *2a, 2b* on the opposite sides of a roll stand 1. The roll stand is generally of such a construction that one of the rolls of base paper *3a, 3b* is adapted to feed a web or strip of paper through a following step or station to work thereupon to the other or taking-up roll of paper, which is seen in this drawing figure to be at a stage of waiting for a splicing procedure. It is also seen arranged such that once the one roll of paper *3a* is fed back while stopping in the feeding process, a paper slicing operation is handled by a web splicing unit 5 so that the other roll of paper *3b* may then be fed in continuation to a following processing step.

The web splicing unit 5 is, as generally known from the disclosure, for instance, of U.S. Pat. No. 4,170,506, equipped with a pair of paper-splicing preprocessing or conditioning members *6a, 6b,* which is arranged slidable in rectilinear fashion as shown by double-headed arrows. The paper-splicing preprocessing members *6a, 6b* are specifically designed to guide the leading edge of a strip of base paper *3a'* while being fed into the working position, and are adapted to hold the leading edge or glued area of another strip of paper *3b'* in position for a splicing procedure to follow. In this construction, it is designed that upon the completion of feeding of the roll of base paper *3a,* or at the time of changing a feed roll for another for the purpose of shifting in the specification of a roll of paper to be fed, such as the quality, the width, etc. thereof, the paper-splicing preprocessing member *6b* serves to hold and urge the leading edge of rolled paper *3b'* upon the opposed edge of paper *3a'* held on the part of the paper-splicing preprocessing member *6a* so that thus-held leading edge may be spliced accordingly, and so that the paper feed operation may be resumed in continuation.

Upon the completion of splicing, the roll of base paper *3a,* which is now out of service, is then removed from the roll carrying arm *2a.* Thereafter this carrying arm *2a* is ready to be reloaded with a new roll of base paper *3c* to be worked upon in a following procedure, and then the leading edge of this roll of paper is placed upon the paper-splicing preprocessing member *6a* in the position shown in a dotted line in FIG. 3, which is then put into the working position shown in a solid line ready for the splicing operation.

Now, from the review of the construction of the rolled paper feed apparatus of the type as given hereinbefore, it is known that while one roll of base paper held on the one of the roll carrying arms is in the feed-out position, it is ready for a paper-splicing operation, but the other roll of paper cannot be put into such splicing operation at all. More specifically, a sequence of troublesome handling is unavoidable in practice such that the roll of paper held on the roll carrying arm, which is now out of service, must first be removed and carried away upon the completion of paper-splicing operation, and then a new roll of paper must be loaded onto the roll carrying arm and then the leading edge of this roll of paper must be held in position by the splicing preprocessing member and further put into the position waiting for the splicing operation, which sequence must be repeated each time upon changing rolls. It would take several minutes for this sequence of handling the rolls of paper to be spliced, which cannot be conducted during such roll changing sequence. In this respect, therefore, this would be a substantial hindrance to the paper-splicing operation, so much so that there would be no capability for high-speed feed operation, the use of a small-sized roll, and frequent changes in the paper roll specification.

In consideration of such drawbacks particular to the conventional construction of a rolled web of paper feed apparatus such as a mill roll stand for use in a corrugated medium forming machine as noted above, it would be desirable to attain an efficient resolution for overcoming such inevitable problems particular to the conventional construction.

SUMMARY OF THE INVENTION

The present invention is essentially directed to the provision of a due and proper resolution to such inconveniences and difficulties in practice as outlined above and experienced in the conventional paper feed apparatus.

It is therefore a primary object of the present invention to provide an improvement in the construction of a paper feed apparatus, which can provide the paper-splicing preprocessing operation smoothly in combination with the roll carrying arm which is under a paper-feeding operation.

Another object of the invention is to provide an improved roll paper feed apparatus, which can provide the improvement in the efficiency of paper-splicing preprocessing work by the provision of separate sites of carry-out-and carry-in jobs of rolled paper.

A further object of the invention is to provide an improved roll paper feed apparatus with a short paper-splicing preprocessing time, which can provide a midway paper-splicing step in the high-speed feeding operation, the use of a small-roll of paper, and frequent changes in the specification of paper rolls.

The above noted objects of the invention can be attained efficiently from an improved paper feed apparatus, having a pair of roll paper carrying arms, each adapted to receive a roll of base paper to be loaded thereupon, and a paper-splicing device, wherein a roll of paper can be fed in continuation from a processing stage to another by switching a supply of web from a plurality of rolls of paper placed in position ready for a splicing operation, according to one aspect of the present invention, which comprises, as summarized in brief, a roll paper feeding station means adjacent to and in operative relationship with respect to the paper-splicing device, a pair of roll carrying means disposed opposedly on opposite sides of the roll paper feeding station means, each adapted to be loaded with a roll of base paper rotatably supported thereon, respectively, said pair of roll paper carrying arm means each being disposed in position between the roll paper feeding station means and the one of roll paper carrying means and adapted to be rotated in swinging motion with respect to the roll paper feeding station means.

The above object of the invention can be attained as desired from an improved roll paper feed apparatus for use in a corrugated medium forming machine, which can provide such an advantage that a new roll of base paper can be carried into the site of the roll carrying means and also be loaded the roll carrying means with its leading edge positioned in a serviceable manner on the paper-splicing preprocessing member even on the part of the roll carrying arm under a roll feeding operation. Also, upon the completion of paper-splicing operation on the new roll of paper, the roll of paper out of service held on the roll carrying arm can then be taken out onto the discharging means, and then the new roll can be put into position for work, thus completing the paper-splicing preprocessing work. During this splicing operation, the discharging means can in parallel take the off-service roll to be carried out of the machine, accordingly.

Additional features and advantages of the invention will now become more apparent to those skilled in the art upon consideration of the following detailed description of a preferred embodiment exemplifying the best mode of carrying out the invention as presently perceived. The detailed description refers particularly to the accompanying drawings, in which like parts are designated with like reference numerals.

DETAILED DESCRIPTION OF THE PREFERRED EMBODIMENT

Figure 1:
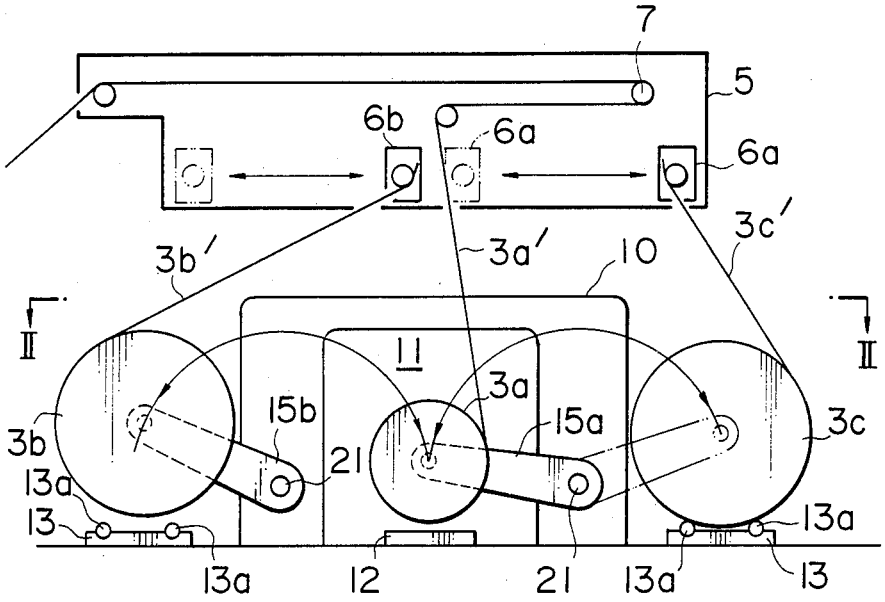
FIG. 1 is a schematic side elevational view showing the general construction of an improved roll paper feed apparatus by way of a preferred embodiment of the present invention.
Figure 3:
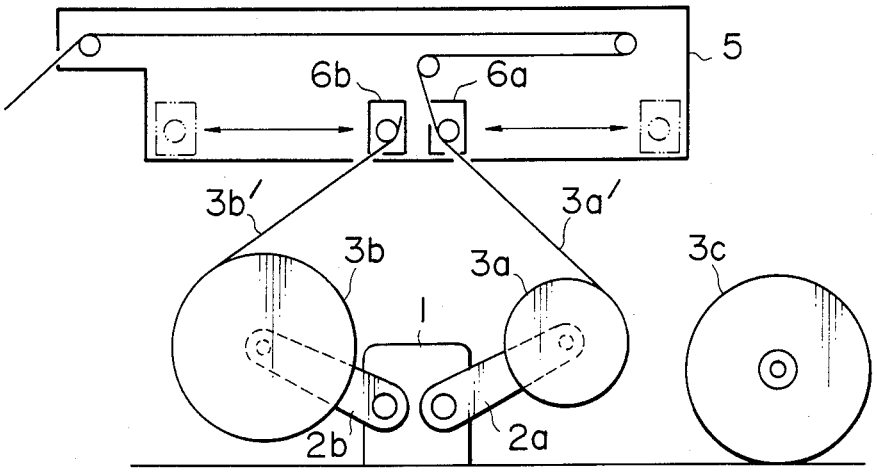
FIG. 3 PRIOR ART
FIG. 3 is a schematic side elevational view showing a conventional roll paper feed apparatus.
Figure 2:
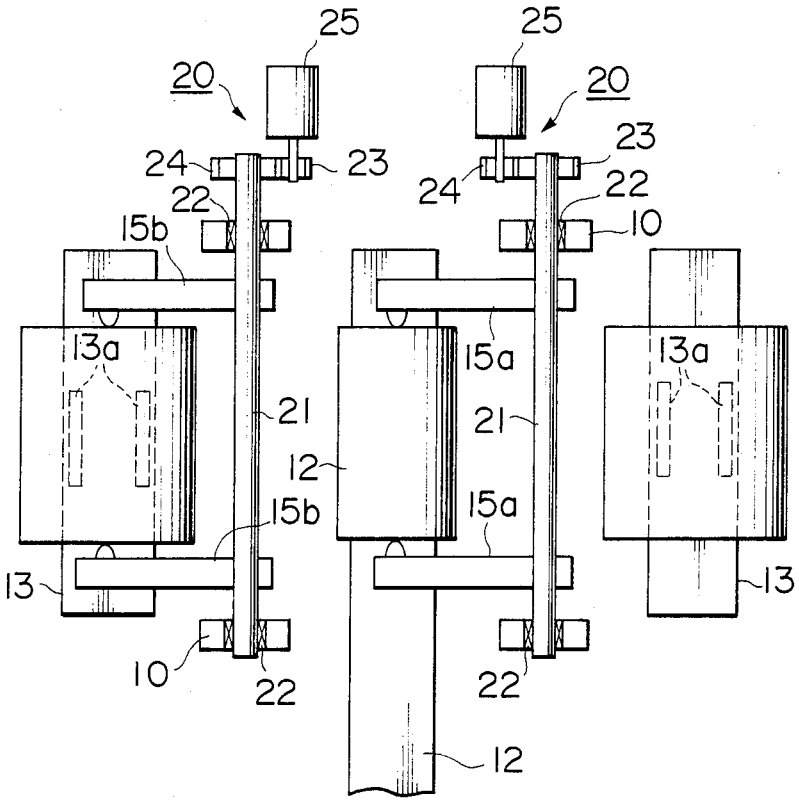
FIG. 2 is a plan view viewed from the plane defined by the line II—II in FIG. 1.

Referring firstly to FIGS. 1 and 2, there is shown provided a paper-splicing device designated as the reference numeral 5, which comprises a pair of paper-splicing preprocessing members *6a, 6b* driven by a common driving mechanism (not shown) slidably between a solid-line position and a dotted-line position shown in FIG. 1, and a plurality of guide rollers 7 for guiding a web of base paper therealong. Each of the paper-splicing preprocessing members *6a, 6b* is constructed to hold the web of base paper at its leading edge by using suitable attracting or absorbing means, which web is unrolled or fed out of the roll of paper, with this leading edge of paper urged onto another web of paper fed out of another roll so as to be spliced in position thereof by way of bonding or welding, etc.

In addition, there is seen provided a web feeding section or station 11, wherein there is placed a roll of base paper under feeding operation, in the lower center of the paper-splicing device 5. Also, there is seen partly a roll carry-out conveyor 12 below the web feeding section 11. There are also provided rolling carriers 13, 13 having rollers *13a* at an appropriate interval across the web feeding section 11. Further, there are rotary driving shafts 21, 21 mounted on frames 10, 10 across the web feeding section 11, upon which shafts 21, 21 there are mounted the roll carrying arms *15a, 15b*, respectively. The roll carrying arms *15a, 15b* can support the rolls of paper at their tip ends, and are operated swingably as shown respectively by arrows in FIG. 1 through the driving in rotating motion of the rotary driving shafts 21, 21.

Next, referring more specifically to a roll paper positioning mechanism 20, as shown specifically in FIG. 2, it is noted that the rotary driving shafts 21, 21 are mounted rotatably by bearings 22 in the frames 10, 10, and that the roll carrying arms *15a, 15b* are secured upon the rotary driving shafts 21, 21, respectively. And further, they are operatively connected to motors 25 through gears 23 disposed at the ends of the rotary driving shafts 21, 21 and gears 24 meshing with the gears 23, respectively. The roll carrying arms *15a, 15b* are caused to move in swinging motion as shown by arrows in FIG. 1 through the forward and rearward rotating motion of the motor 25 by way of the gears 23, 24 and the rotary driving shafts 21, 21, respectively. Also, the roll carrying arms *15a, 15b* can be driven in back and forth motion only axially relative to the rotary driving shafts 21, 21 by way of an appropriate mechanism (not shown), whereby the roll of paper can be mounted rotatably onto and removed out of the carrying arms, respectively.

By way of such embodiment of the present invention as noted hereinbefore, the rolls of base paper *3a, 3b* are loaded rotatably on the roll carrying arms *15a, 15b*. As shown in FIG. 1, the web of base paper *3a'* unrolled from one roll of paper *3a* is threaded through the guide rolls in the paper-splicing device 5 and runs into following procedures (omitted in the figure) in the roll paper processing operation. The other roll of base paper *3b* is loaded rotatably on the roll carrying arms *15b* of the rolling carrier 13, with its leading edge extending up to the paper-splicing preprocessing member *6b* where it is held in position close to the running web of paper *3a'* and ready for being spliced together, when so required.

According to this construction, it is advantageous that the roll of base paper *3a* from which the web *3a'* is fed out is already located in the working position in the web feeding section 11, and consequently, it is not necessary to take any further steps such as guiding the web of paper *3a'* and setting it into working position in the paper-splicing preprocessing member *6a*. In operation, the paper-splicing preprocessing member *6a* is first moved slidably into a right hand position shown by a solid line as viewed in FIG. 1, and then a new or third roll of base paper *3c* is carried in and placed onto the rolling carrier 13 on the same or right side of the machine, where the leading edge of its web being unrolled out of the roll *3c* is then placed into engagement with the paper-splicing preprocessing member *6a* so that it is ready for a following step of splicing operation.

When the web of base paper *3a* under a processing operation is to be switched into another web of base paper *3b*, the paper-splicing preprocessing member *6b* shown by a solid line in FIG. 1 is shifted slidably into a further right position so that the leading edge of the web of base paper *3b'* from the roll *3b* may be urged onto the running web of paper *3a'*, at which moment it is spliced by way of glue or welding upon the opposed surface of the web of paper *3a'*, and at the same time the latter is cut away from the point of contact.

Upon the stopping of the roll of base paper *3a* and disconnection from the feeding service the roll *3a* is then removed out of the roll carrying arms *15a* and then carried out of the machine by using the roll carry-out conveyor 12. At the same time, the roll carrying arms 15*a* are rotated clockwise in swinging motion as viewed in FIG. 1 so that the roll of base paper 3*c* waiting for service upon the rolling carrier 13 is then loaded thereupon, and the paper-splicing preprocessing member 6*a* is shifted toward the left position shown by a dotted line in FIG. 1, where it is ready for a splicing operation to follow.

On the other hand, the roll of base paper 3*b* under a paper feed operation is then turned into the web feeding station 11 by the rotating motion of the roll carrying arms 15*b* in the clockwise direction. Since the paper-splicing preprocessing member 6*b* is then not in a guide and holding position any longer, it is now returned in sliding motion to the left side of the machine, or a preliminary paper-splicing position for a next roll of paper (not shown).

Now, according to such a unique construction of a rolled web of paper feed apparatus such as a mill roll stand for use in a corrugated medium forming machine as typically shown by way of the preferred embodiment of the present invention wherein there are provided the rolling carriers on the opposite sides of the web feeding station, on which rolling carriers there are mounted new rolls of base paper, and wherein the leading edge of such a roll of paper is held preliminarily in a working position for the paper-splicing device, there is attained such an advantageous effect that even when another roll of paper is under a feeding operation, a new roll of paper can be set to be ready for a paper-splicing operation, so that a quick job of loading and unloading the roll of paper onto and out of a roll carrying arms can be made possible in practice, which contributes to a substantial improvement in the efficiency of paper-splicing services in the paper roll processing operation, accordingly.

It is now clear that the objects as set forth hereinbefore among those made apparent from the preceding description are efficiently attained, and while the present invention has been explained by way of the preferred embodiments thereof, it is to be understood that many changes and modifications may be made in the foregoing teaching without departing from the spirit and scope of the invention, and it is intended that all matter contained in the foregoing description or shown in the accompanying drawings shall be interpreted as illustrative and not in any way in a limiting sense.

It is also to be understood that the appended claims are intended to cover all of such generic and specific features particular to the invention as disclosed herein and all statements relating to the scope of the invention, which as a matter of language might be said to fall thereunder.

What is claimed is:

1. A roll paper feed apparatus comprising a pair of roll paper carrying arms, each adapted to receive a roll of base paper to be loaded thereupon and to be unloaded therefrom, a paper splicing device wherein a roll of paper can be fed in continuation from a processing stage to another by switching a supply of web from a plurality of rolls of paper placed in position ready for a splicing operation, a roll paper feeding section adjacent to and in operative relationship with said paper splicing device, and a pair of roll carrying means disposed on opposite sides of said roll paper feeding section, each of said roll carrying means adapted to be loaded with a roll of base paper rotatably supported thereon, said pair of roll paper carrying arms each being disposed in position between said roll paper feeding section and one of said roll paper carrying means and adapted to be rotated in swinging motion with respect to said roll paper feeding section to move rolls of base paper from said roll carrying means to said paper feeding section.

2. A roll paper feed apparatus as claimed in claim 1, which further comprises a roll paper discharging means disposed in cooperative position below said roll paper feeding section.

3. A roll paper feed apparatus as claimed in claim 2, wherein said roll paper discharging means comprises a conveyor means.

4. A roll paper feed apparatus as claimed in claim 1, wherein said pair of roll paper carrying means each comprise a stationary mount and a plurality of rollers disposed rotatably upon the upper surface of said stationary mount and adapted to receive said roll of base paper thereon.

* * * * *